US010562257B2

(12) United States Patent
Gambini

(10) Patent No.: US 10,562,257 B2
(45) Date of Patent: Feb. 18, 2020

(54) METHOD FOR PRODUCING A PAPER ROLL WITH SMOOTH PLIES AND RELATIVE ROLL

(71) Applicant: GAMBINI S.p.A., Milan (IT)

(72) Inventor: Gianni Gambini, Turchetto-Montecarlo (IT)

(73) Assignee: GAMBINI S.P.A., Milan (IT)

( * ) Notice: Subject to any disclaimer, the term of this patent is extended or adjusted under 35 U.S.C. 154(b) by 277 days.

(21) Appl. No.: 15/608,473

(22) Filed: May 30, 2017

(65) Prior Publication Data

US 2017/0355165 A1 Dec. 14, 2017

(30) Foreign Application Priority Data

Jun. 10, 2016 (IT) ..... 102016000059927

(51) Int. Cl.
*B31F 1/07* (2006.01)
*D21F 11/08* (2006.01)

(52) U.S. Cl.
CPC ..... *B31F 1/07* (2013.01); *D21F 11/08* (2013.01); *B31F 2201/073* (2013.01); *B31F 2201/0753* (2013.01); *B31F 2201/0787* (2013.01)

(58) Field of Classification Search
None
See application file for complete search history.

(56) References Cited

U.S. PATENT DOCUMENTS

| | | | | |
|---|---|---|---|---|
| 4,610,743 | A | 9/1986 | Salmeen et al. | |
| 5,443,889 | A | 8/1995 | Ruppel et al. | |
| 2005/0103434 | A1 | 5/2005 | Andersson et al. | |
| 2009/0255622 | A1* | 10/2009 | Hungler | B31F 1/07 156/209 |
| 2011/0132526 | A1* | 6/2011 | Petri | B31F 1/07 156/209 |

* cited by examiner

*Primary Examiner* — Barbara J Musser
(74) *Attorney, Agent, or Firm* — King & Schickli, PLLC

(57) ABSTRACT

A method for producing a paper roll by conveying a first smooth ply between an upper embossing roll with first projections defining a decorative motif, and a glue distribution or cliché roll; maintaining the cliché roll side by side to the upper embossing roll, the first ply interposed between the upper embossing roll and the cliché roll and subjected to incisions and to glue deposits at the first projections on one side of the first ply facing towards the upper embossing roll and on the opposite side of the first ply facing towards the cliché roll; conveying a second ply between the upper embossing roll and a coupling or marriage roll; maintaining the marriage roll side by side to the upper embossing roll by exerting a coupling pressure to perform the final coupling between the first ply and the second ply at the glue deposits forming a multilayer paper.

5 Claims, 3 Drawing Sheets

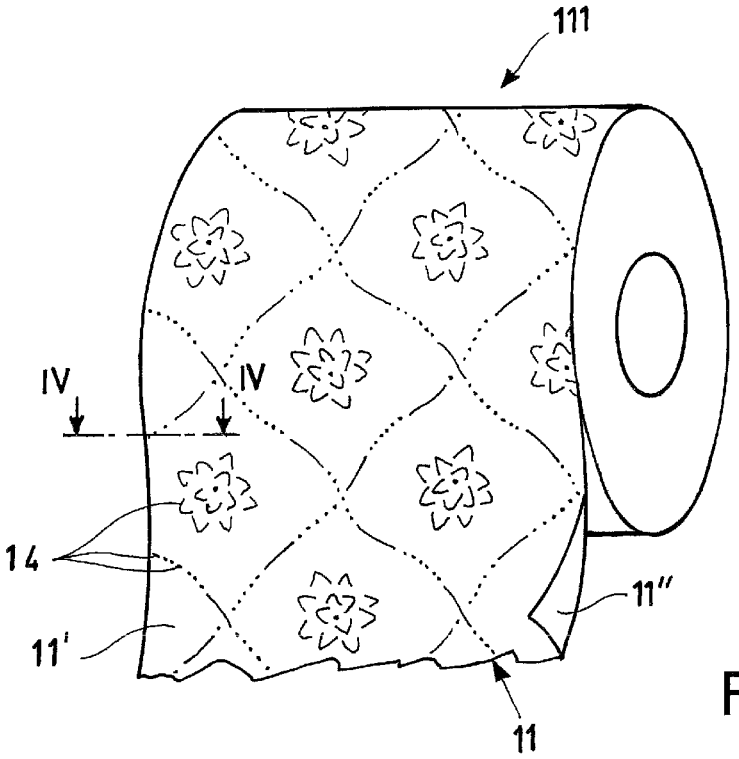
Fig.3
Fig.4
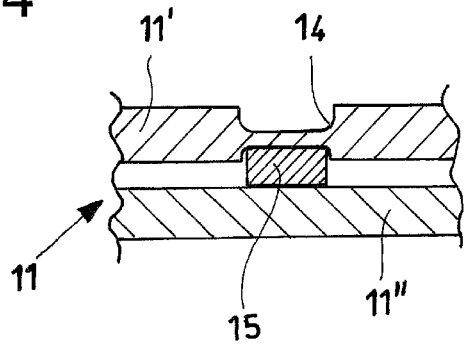

METHOD FOR PRODUCING A PAPER ROLL WITH SMOOTH PLIES AND RELATIVE ROLL

This application claims the benefit of Italian Patent Application Ser. No. 102016000059927, filed Jun. 10, 2016, the disclosure of which is incorporated herein by reference.

TECHNICAL FIELD

The present invention relates to a method for producing a paper roll with smooth plies and a relative roll.

BACKGROUND

It is known to produce multilayer paper rolls, either toilet paper or kitchen paper, by means of a so-called embossing and lamination process, in which on each of the paper plies, generally two, projections are formed, called embossments, at one or more heights and adhesive material is applied near at least part of such embossments for coupling the two plies.

As shown in FIG. 1, according to the prior art, an embossing-lamination assembly 100 comprises two pairs each consisting of a steel embossing roll 101 and a rubber embossing counter-roll 102, between which a first paper ply 11' and a second paper ply 11", respectively, are returned with the aid of relative return rolls 103.

The upper steel embossing roll 101 is generally provided with projections arranged according to two different heights. Following the passage of the first paper ply 11', the upper pair consisting of the steel embossing roll 101 and the rubber embossing counter-roll 102, the projections at greater height of the embossing roll 101 emboss projections on the first paper ply 11' defining a decorative motif having a first height and the projections at smaller height emboss projections with smaller height on the same first paper ply 11' defining a dotted background motif, called microembossing. The upper embossing roll may also have only projections of the same height, optionally defining a decorative motif.

The lower steel embossing roll 101 is generally provided with projections all of the same height. Following the passage of the second paper ply 11" between the lower pair consisting of the steel embossing roll 101 and the rubber embossing counter-roll 102, the projections of the lower embossing roll 101 emboss projections having a constant height on the second paper ply 11" defining a dotted background motif, called microembossing.

In the embossing and lamination assembly, the upper steel embossing roll 101 is, on one side, in abutment with a glue distribution assembly and on the opposite side, in abutment with a coupling roll 107, called marriage roll. In particular, the upper steel embossing roll 101 is in abutment with a glue distribution roll 104, called cliché roll, which distributes on the embossed paper ply the glue that has been transferred to it by the screened roll 105, in turn also coupled with a glue tank 106. In particular, in the known embossing and lamination assembly 100, the glue is applied by the cliché roll 104 on the projections with greater height of the first embossed paper ply 11'. On the opposite side, the marriage roll 107 presses the two paper plies against each other to ensure the gluing thereof to form a multilayer paper 11.

As known, this process allows producing high-volume paper, depending on the specific embossed decorations, imparted by the empty spaces between the glue dots, and provided with a surface decoration, given by the embossed motif, optionally accentuated by the use of colored adhesive material.

Specific market application needs, however, sometimes require the production of small-volume paper rolls which, for example, negatively affects the transport costs of the finished product.

In order to reduce the volume of paper rolls, it is known to use smooth plies, i.e. not embossed, coupled without glue by means of the so-called ply-bonding, i.e. imparting a pressure between the plies along continuous longitudinal lines. This process, however, spoils the appearance of the final product, which is affected by the typical compressed rings.

The market, more and more demanding as regards the final features of the product, however, more and more often requires, as a sign of quality, that the product does not have damage to the paper plies and that a decorative motif is also present.

It is also known to couple smooth plies by means of adhesive material sprayed continuously with nozzles. However, this solution requires a thorough and costly calibration of the nozzles, in particular on the basis of the speed of the paper plies, in addition to not allowing the application of decorative motifs, unless they are printed in advance on the plies, with relative increased cost.

Document U.S. Pat. No. 5,443,889 A shows two plies of paper glued together in discrete areas which corresponds to areas of reduced thickness on both outer surfaces of the plies of paper providing a pattern. Two steel cylinders, the surfaces of which bear engraved patterns, rotate synchronously so that the raised zones are congruent in the pressing zone. The first ply is wound without deforming on the surface of the first cylinder and glue is applied on the first ply in correspondence with the superficial pattern of the cylinder by means of a conventional glue-depositing device provided with a glue dispensing cylinder in contact with the ply. The second ply is wound on the surface of the second cylinder. The two plies, with glue locally deposited in the first ply, touch each other at the contact point of the cylinders where, on account of the compression by the two cylinders, they are simultaneously marked and bonded.

SUMMARY

The aim of the present invention is to provide a method for producing a paper roll with smooth plies having a small volume, in which the paper plies are not damaged and are provided with a decorative motif.

Another aim of the present invention is to provide a method for producing a paper roll with smooth plies and a relative roll particularly simple and functional, as well as cost-effective.

These aims according to the present invention are achieved by providing a method for producing a paper roll with smooth plies and a relative roll as set out in the independent claims.

Further characteristics are described in the dependent claims.

BRIEF DESCRIPTION OF THE DRAWING FIGURES

The characteristics and the advantages of a method for producing a paper roll with smooth plies and a relative roll according to the present invention will become more apparent from the following exemplary and non-limiting description, made with reference to the accompanying drawings, in which:

FIG. 3 shows an example of a paper roll object of the present invention;

FIG. 4 shows in enlarged detail a section according to the section plane IV-IV of FIG. 3.

DETAILED DESCRIPTION

Figure 1:
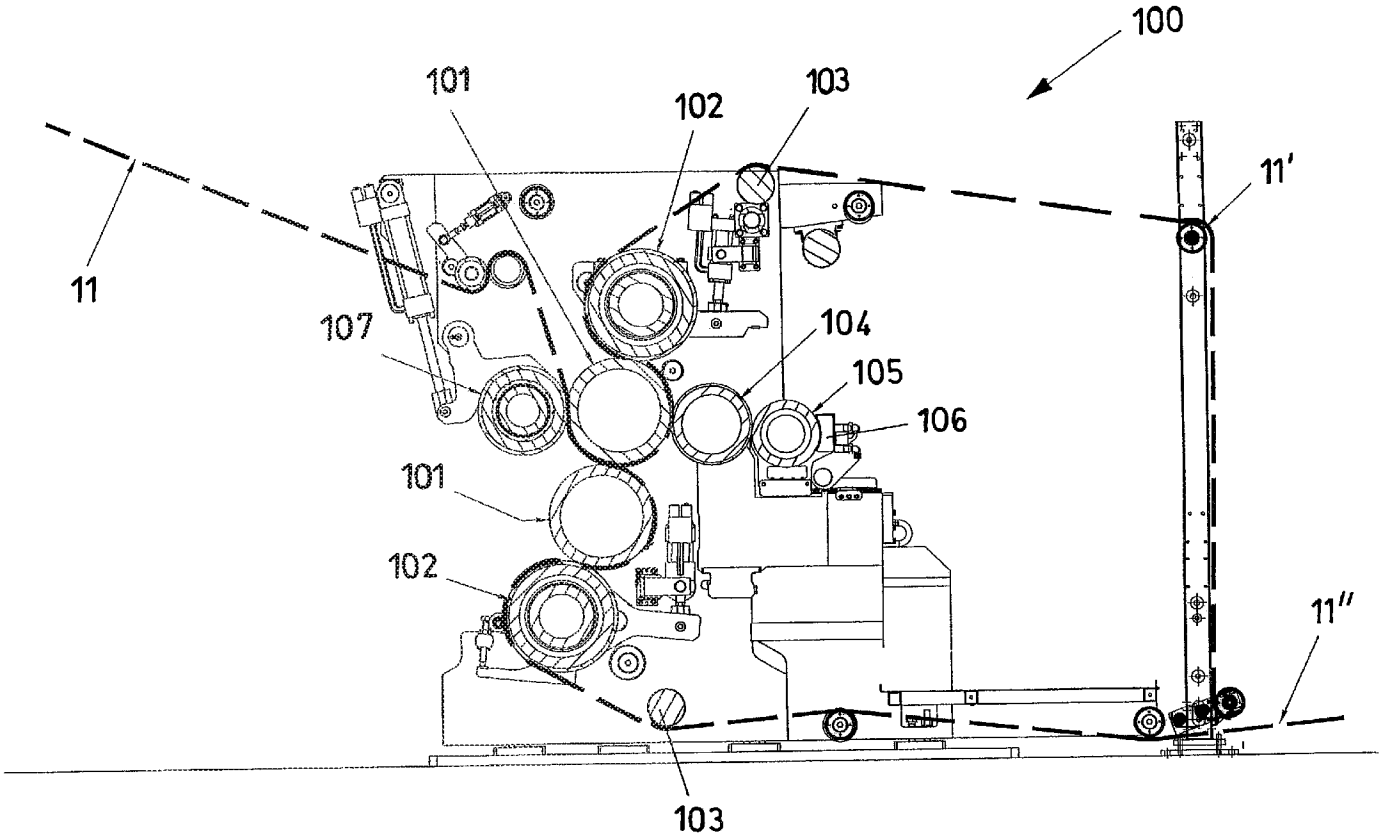
Fig. 1 PRIOR ART
FIG. 1 is a schematic view of an embossing and lamination assembly according to the prior art on which a traditional gluing process is performed on the projections obtained on the upper paper ply by embossing.
Figure 2:
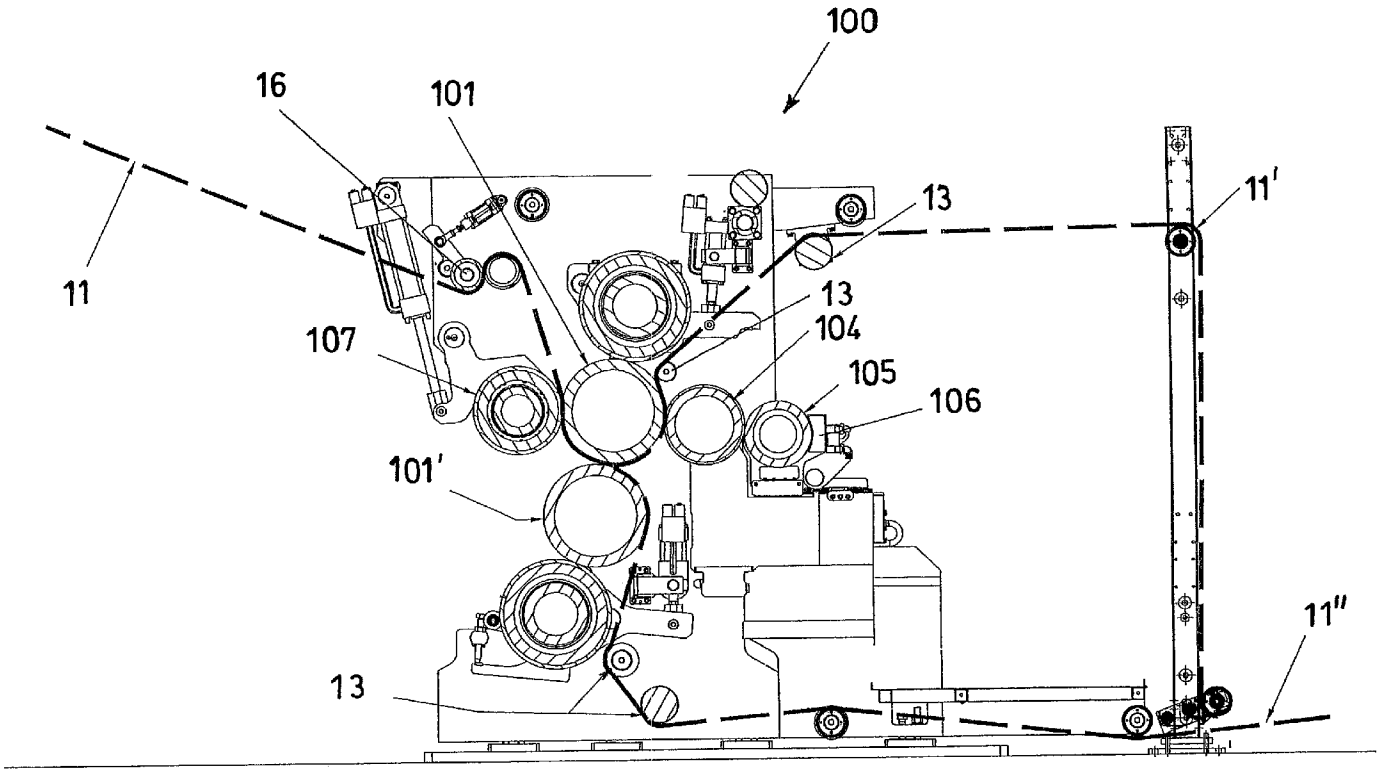
FIG. 2 is a schematic view of an embossing and lamination assembly during the implementation of the method for producing a paper roll with smooth plies object of the invention.

With reference to FIGS. 2 to 4, they exemplify the implementation of a method for producing a paper roll with smooth plies, for example by means of an embossing and lamination assembly 100, and a relative roll 111 is shown.

The method according to the present invention may be implemented by means of an embossing and lamination assembly 100, such as that of the prior art shown in the figures, as well as by means of a simplified lamination assembly, wherein both rubber counter-rolls 102 can be entirely absent, not being involved in the method of the invention, and wherein the lower steel embossing roll, generally provided with projections defining a microembossing, and which according to the invention only contributes to mechanically pulling the second smooth ply 11", can be replaced by any roll feeding device, such as an emery cloth roll or a press system, not shown.

In order to implement the method according to the invention, the first smooth paper ply 11' is conveyed with the aid of return rolls 13 between the upper steel embossing roll 101 and the glue distribution roll 104, the so-called cliché roll, preferably with an angle such as to wind on the upper embossing roll 101 or at most be inserted with an almost tangential angle between the two rolls. By almost tangential it is meant that an angle of insertion of the first paper ply 11' between the two rolls just beyond the tangency is also admitted, that is to say, closer to the cliché roll 104, provided that it is not wound on the cliché roll 104, which would result in an incorrect distribution of glue on the paper ply 11'.

By "smooth ply 11""" it is meant a ply without embossments, that is projections, out of the thickness of the ply.

The upper embossing roll 101 may have projections of dual height or single height without distinction. In the case of upper embossing rolls 101 provided with double-height projections, only the projections with greater height are involved in the process according to the invention.

The cliché roll 104, conventionally made of high hardness rubber, is covered with glue by the effect of the screened roll 105, according to the operating principle of glue groups also used in the embossing and lamination processes, and is maintained side by side to the upper embossing roll 101. By "side by side" it is meant both that it is maintained at a certain distance which can be adjusted according to the thickness of the paper, and alternatively that it is pressed against the upper embossing roll 101 with a predetermined and continuously controllable pneumatic pressure.

The first paper ply 11' is then pressed between the upper embossing roll 101 and the cliché roll 104, incisions 14, also called "markings", being thus embossed in ply 11' itself in positions corresponding to the projections of the steel embossing roll, predominantly visible on the side of the first paper ply 11' facing in contact with the upper embossing roll 101. By "incision" 14, or marking, it is meant a thinning of the thickness of the first ply 11' of the order of tenths of a millimeter, within the bulk defined by the maximum thickness of the smooth ply, i.e. that does not generate any projection out of the thickness of the paper ply, as is the case for traditional embossing. The first ply 11' therefore remains smooth even after making incisions 14.

Simultaneously with the formation of incisions 14, on the opposite side of the first ply 11', the cliché roll 104 lays an amount of glue 15 only at the projections of the embossing roll, which form an abutment surface during the application of the glue. Therefore, at the projections of the upper embossing roll 101, incisions 14 are formed on the first paper ply 11' and glue deposits 15 are formed on the opposite side.

The second smooth paper ply 11", that is without embossments, is conveyed with the aid of return rolls 13 and a feed roll 101', in the example consisting of the lower embossing roll, between the upper embossing roll 101 and the coupling roll 107, or marriage roll.

The marriage roll 107, which is conventionally made of high hardness rubber or of steel, is maintained side by side to the upper embossing roll 101 and exerts a coupling pressure between the two plies 11' and 11" to perform the final coupling at the glue deposits 15, thus forming a multilayer paper 11. The marriage roll 107 may be alternatively maintained at a certain distance which can be adjusted or may be pressed against the upper embossing roll 101 with a predetermined and continuously controllable pneumatic pressure.

The coupling by pressure between the two plies 11' and 11" takes place only between the upper embossing roll 101 and the marriage roll 107 and not also between the upper embossing roll 101 and the feed roll 101', which are not in contact with each other.

The multilayer paper 11 is then conveyed through a press system 16 towards the paper roll wrapping line, not shown.

The multilayer paper 11 thus produced is then rolled up to form a roll 111, called log, so as to have on the outer side of the roll 111 the first smooth paper ply 11', provided with incisions 14 defining a decorative motif, and on the inner side of the roll the second smooth ply 11", without incisions.

According to the invention the "smooth" plies may be provided with a microembossing, that as known is characterised by a height that is negligible with respect to the height of an embossing, the microembossing being for example distinguished by an height of about 0.5 mm.

The use of colored glue results in greater evidence of the decorative motif consisting of incisions 14 on the first ply 11'.

The method for producing a paper roll with smooth plies and the relative roll according to the present invention have the advantage of achieving an aesthetically pleasing appearance indicative of high product quality in a product with small volume.

Advantageously, any decorative motif used for the embossing rolls can be embossed as an incision into the roll of the present invention. Embossing rolls with double height as well as with single height can be advantageously used interchangeably in the implementation of the present invention.

Another advantage is the possibility to implement the method of the invention on traditional embossing and lamination assemblies without requiring dedicated equipment and with minimal adjustments of the same, at most consisting of the position of some return rolls.

The method requires advantageously the provision of one single engraved cylinder resulting in economic savings and simplification of operation.

The method for producing a paper roll with smooth plies and the relative roll thus conceived are susceptible of numerous modifications and variations, all falling within the invention; moreover, all details can be replaced with technically equivalent elements. In the practice, the materials used as well as the dimensions, can be any, according to technical requirements.

The invention claimed is:

1. Method for producing a paper roll (111) with smooth plies joined together with glue comprising the steps of conveying a first ply (11') between an upper embossing roll (101), provided with at least first projections defining a decorative motif, and a glue distribution roll (104), or cliché roll;

maintaining the cliché roll (104) side by side to the upper embossing roll (101), said first ply (11') being interposed between said upper embossing roll (101) and said cliché roll (104) and, when passing between said two rolls (101, 104), being subjected to incisions (14) and to glue deposits (15) in positions corresponding to said first projections of the embossing roll defining a decorative motif, respectively on one side of the first ply (11') facing towards the upper embossing roll (101) and on the opposite side of the first ply (11') facing towards the cliché roll (104);

conveying a second ply (11") between the upper embossing roll (101) and a coupling roll (107), or marriage roll;

maintaining the marriage roll (107) side by side to the upper embossing roll (101) by exerting a coupling pressure in order to perform the final coupling between said first ply (11') and said second ply (11") at the glue deposits (15), thus forming a multilayer paper (11).

2. Method according to claim 1, characterized in that said cliché roll (104) is maintained pressed against said upper embossing roll (101) through a predetermined pneumatic pressure that can be continuously controlled.

3. Method according to claim 1, characterized in that said first ply (11') is conveyed between said upper embossing roll (101) and said cliché roll (104) with an almost tangential angle or wound on the upper embossing roll (101).

4. Method according to claim 1, characterized in that said incisions (14) are made as a thinning of the thickness of the first ply (11') of the order of tenths of a millimeter within the bulk defined by the maximum thickness of the smooth ply (11').

5. Method according to claim 1, characterized in that said second ply (11") conveyed between said upper embossing roll (101) and said marriage roll (107) is smooth.

* * * * *